US005115554A

United States Patent [19]

Fell, Sr.

[11] Patent Number: 5,115,554

[45] Date of Patent: May 26, 1992

[54] CLOSET FLANGE

[75] Inventor: Donnie R. Fell, Sr., 3500 Tates Creek Rd., Lexington, Ky. 40517

[73] Assignees: James L. Holman; Donnie R. Fell, Sr., Lexington, Ky.

[21] Appl. No.: 629,928

[22] Filed: Dec. 19, 1990

[51] Int. Cl.[5] ..... E03D 11/13; F16L 55/10

[52] U.S. Cl. ..... 4/252.4; 4/295; 4/252.5; 138/90; 285/58

[58] Field of Search ..... 4/252 R, 295; 138/89, 138/90; 285/303, 58

[56] References Cited

U.S. PATENT DOCUMENTS

| | | | |
|---|---|---|---|
| 694,140 | 2/1902 | Crawford . | |
| 888,683 | 5/1908 | Andrews . | |
| 1,436,331 | 11/1922 | Ayling . | |
| 2,658,434 | 11/1953 | Miller . | |
| 3,148,708 | 9/1964 | Panella . | |
| 3,263,244 | 8/1966 | Katz | 4/252 R |
| 3,319,268 | 5/1967 | Blumenkranz | 4/252 R |
| 3,775,780 | 12/1973 | McEwen | 4/252 R |
| 4,554,949 | 11/1985 | Sell . | |
| 4,827,539 | 5/1989 | Kiziah | 285/303 X |
| 4,848,155 | 7/1989 | Huber | 138/90 X |

*Primary Examiner*—Daniel M. Yasich
*Attorney, Agent, or Firm*—Frost & Jacobs

[57] ABSTRACT

A closet flange for mounting a water closet and connecting the water closet to standard plumbing means leading to a soil pipe and vent assembly. The closet flange comprises a cylindrical body with upper and lower body portions and an axial bore. The upper body portion defines the entrance end of the body and supports an exterior annular attachment flange at the entrance end. The lower body portion defines the exit end of the body and is configured to connect with the standard plumbing means. The axial bore is provided with standard pipe threads for threaded engagement by a standard threaded screw plug to close the axial bore and seal the axial bore for air or water testing prior to installation of a water closet on the attachment flange.

3 Claims, 4 Drawing Sheets

CLOSET FLANGE

TECHNICAL FIELD

The invention relates to a closet flange, and more particularly to a closet flange having internal threads near its entrance end to be engaged by the threads of a conventional threaded plug to close the closet flange in the absence of a water closet mounted thereon and to seal the closet flange for air or water testing.

BACKGROUND ART

It is conventional practice to provide a closet flange at the location of each water closet to be installed in a home, building or the like. The closet flange has a cylindrical body portion which extends through an opening in the floor and a surrounding flange at its inlet end which overlies the floor and is affixed thereto. The water closet, when installed, is mounted on the closet flange and is bolted thereto. The closet flange not only serves as a mounting means for the water closet, but it also connects the water closet to the plumbing leading to the soil pipe and vent pipe assembly, all as is well known in the art.

In the plumbing industry today, it is common to make piping such as soil pipe and the like, and fittings such as elbows, closet flanges, standard threaded plumbing plugs and the like of plastic material such as acrylonithile-butadiens-styrene (ABS) or polyvinylchloride (PVC). While the teachings of the present invention are equally applicable to metallic pipe and pipe fittings, for purposes of an exemplary showing, the invention will be illustrated in its application to plastic closet flanges to be used with plastic fittings and soil pipe.

During plumbing construction it is frequently desirable or required to perform an air test or a water test to assure that the various joints and the like are properly connected and sealed. According to prior art practices, various types of plug means were attached directly to the soil pipe to seal the pipe for purposes of such testing, prior to the installation of the closet flange. Although relatively low pressures are used in such testing, the various plug means used were frequently subject to "blow-out," requiring resealing and retesting.

Prior art workers have developed a closet flange with a knock-out closure member at its inlet end, the closure member constituting an integral, one-piece part of the molded plastic closet flange. This integral closure member not only closes the inlet end of the closet flange, but also enables water and air tests to be conducted with the closet flange in place. However, when a water closet is to be mounted on the closet flange, the integral knock-out closure member is removed by an appropriate blow or blows of a suitable tool such as a hammer. Frequently, the knock-out closure member, once broken away, falls down into the plumbing, sometimes resulting in a removal problem.

The present invention is based upon the discovery that if the entrance end of an otherwise conventional molded plastic closet flange is modified so as to be provided with a series of standard plumbing threads, it can temporarily be closed and sealed by means of a standard 3" or 4" screw plug. Such screw plugs are well-known in the art, and are most commonly available in 3" and 4" diameters. The closet flange can be so sized as to accommodate a 3" or a 4" standard plumbing plug.

The improved closet flange of the present invention has been found to provide a number of advantages. First of all, the plumbing can be completed up to and including installation of the closet flange and the closet flange can be easily closed until such time as a water closet is installed thereon. The use of a conventional screw plug enables sealing of the system for purposes of air or water testing. The plug provides an essentially fail-safe seal. Furthermore, for test purposes, a conventional screw-base air or water test gage can be threadedly engaged in the closet flange, making an adequate seal. Finally, the interior configuration of the entrance end of the closet flange, including the threads, enables the use of a horned wax ring, if desired. This will be illustrated hereinafter.

DISCLOSURE OF THE INVENTION

According to the invention there is provided a closet flange for mounting a water closet and for connecting the water closet to conventional plumbing means leading to a conventional soil pipe and vent assembly. The closet flange comprises a cylindrical body with an axial bore and having upper and lower body portions. The lower body portion is configured for connection to conventional plumbing means leading to a conventional soil pipe and vent assembly. The upper body portion terminates in an entrance end. An exterior, horizontal, annular, conventional attachment flange is located at the entrance end.

The cylindrical body of the closet flange is adapted to extend through a perforation in the floor or other appropriate supporting surface. The conventional external attachment flange enables attachment of the closet flange to the floor and attachment of a water closet to the closet flange, itself.

The axial bore of the closet flange is internally threaded with standard pipe threads near the entrance end of the cylindrical body, for threaded engagement by a standard threaded screw plug to close the central bore and seal the central bore for air or water testing prior to installation of a water closet on said attachment flange.

DESCRIPTION OF THE PREFERRED EMBODIMENTS

As is well known in the art, water closets are connected by appropriate plumbing elements to soil pipe and vent assemblies. In the usual practice, the soil pipe and vent assemblies, together with the connecting plumbing elements are erected. The free end of the connecting plumbing which would normally be attached to a closet flange, is provided with a temporary sealing closure, which not only precludes foreign material from entering the plumbing, but also enables air or water pressure testing.

Figure 1:
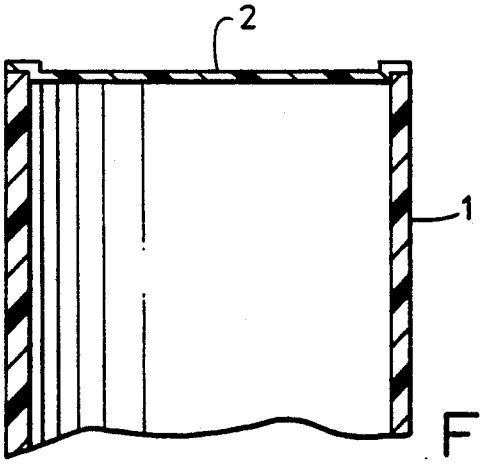
FIG. 1 PRIOR ART
FIG. 1 is a fragmentary, cross-sectional view of a piece of conventional plastic soil pipe provided with an exemplary form of prior art seal.

FIG. 1 illustrates the free end of the connecting plumbing which would normally attach to a closet flange. The plumbing element, indicated at 1, is closed at its free end by a thin, web-like cap, glued to the end of the plumbing element 1. The cap 2, is sometimes referred to as a "wafer cap."

Figure 2:
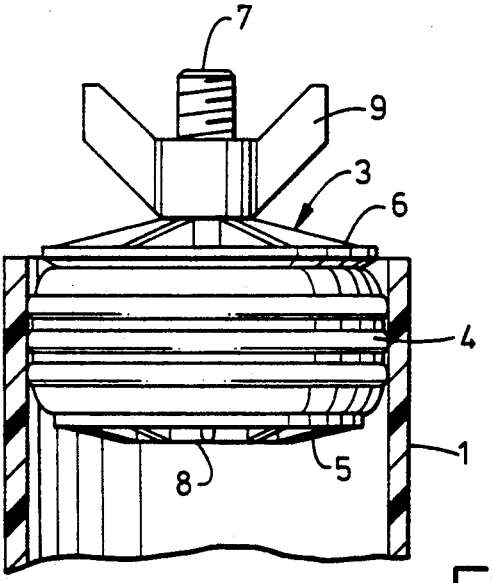
FIG. 2 PRIOR ART
FIG. 2 is a fragmentary, cross-sectional view of a piece of conventional plastic soil pipe provided with another form of prior art seal.

FIG. 2 illustrates the free end of plumbing element 1 provided with another well-known type of sealing means. The sealing element, generally indicated at 3, comprises a resilient, annular rubber member 4 engaged between a pair of plate-like members 5 and 6. A bolt 7 has its head 8 captively associated with plate 5. The bolt 7 passes through the central opening in the annular rubber member 4 and through a central perforation in plate 3. The free end of bolt 7 is provided with a wing-nut 9.

As will be understood by one skilled in the art, the normal outside diameter of rubber element 4 and the outside diameter of each of plates 5 and 6 are such as to enable the plug 3 to be received within the pipe element 1. Tightening of wing-nut 9 will cause plate 6 to shift toward plate 5, squeezing the rubber element 4 and thereby increasing its outside diameter. In this way the rubber element 4 can be made to make a sealing engagement with the pipe unit 1, sealing the free end thereof.

A problem encountered with seals of the type just described lies in the fact that if the seals 2 or 3 are not properly engaged with the pipe unit 1, they will "blow off" during a water or air pressure test. Wafer caps of the type illustrated in FIG. 1, for example, can demonstrate blow-out as much as 50% of the time. In order for an adequate glue joint to be formed between the end of pipe unit 1 and the wafer cap 2, the end of pipe unit 1 must be cut substantially perpendicular to the axis of the pipe unit, and must be reasonably clean.

Figure 3:
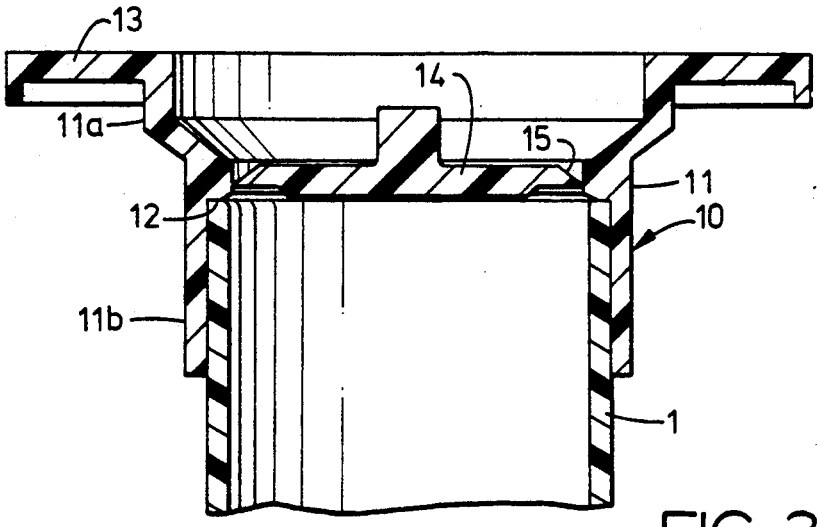
FIG. 3 PRIOR ART
FIG. 3 is a fragmentary, cross-sectional view illustrating a piece of conventional plastic pipe and a prior art closet flange of the type having a closure member comprising an integral, one-piece part of the closet flange.

FIG. 3 illustrates another prior art solution to the problem. In FIG. 3, the free end of the pipe unit 1 is shown glued to a closet flange, generally indicated at 10. The closet flange 10 has a cylindrical body 11 comprising an upper portion 11*a* and a lower portion 11*b*. The upper portion 11*a* defines the entrance end of the closet flange. The lower portion 11*b* provides a female socket adapted to receive the free end of pipe unit 1. The interior of closet flange 10 is provided with an annular stop shoulder 12 for abutment by the free end of pipe unit 1. The pipe unit 1 is attached to the closet flange 10 by appropriate adhesive means, as is well known in the art.

The closet flange 10 is provided with a conventional, external, annular, attachment flange 13, located adjacent the entrance end of the closet flange.

As thus far described, the closet flange 10 is conventional. The closet flange 10 differs from the usual in that it is provided with a closure or plug 14. The plug 14 is an integral, one-piece, unitary part of the molded closet flange 10. The plug 14 closes and seals the central bore of the closet flange 10, and therefore closes and seals the free end of the plumbing unit 1. Until such time as a water closet is mounted on the flange 13 of the closet flange 10, the plug 14 will prevent foreign material from entering the plumbing and will permit air or water pressure testing.

It will be noted that an annular notch is provided at the juncture of the plug 14 and the cylindrical wall 11 of closet flange 10. The notch 15 reduces the thickness of the plug and enables the plug to be removed by a simple blow from an appropriate tool such as a hammer or the like. A problem arises in that once the plug 14 has been broken away from the cylindrical body 11 of the closet flange 10, the plug 14 will fall downwardly into the plumbing assembly leading to the soil pipe and vent assembly and is sometimes difficult to extract.

Figure 4:
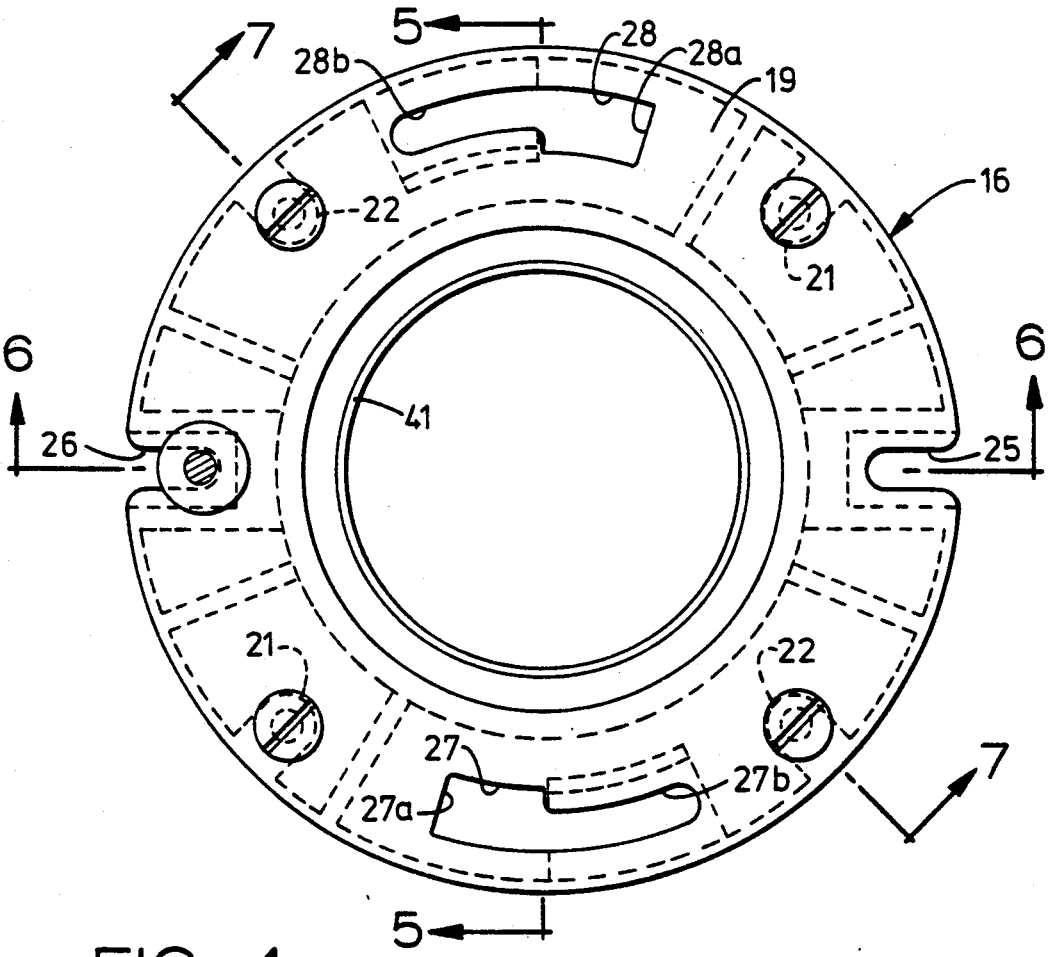
FIG. 4 is a plan view of a closet flange of the present invention.
Figure 5:
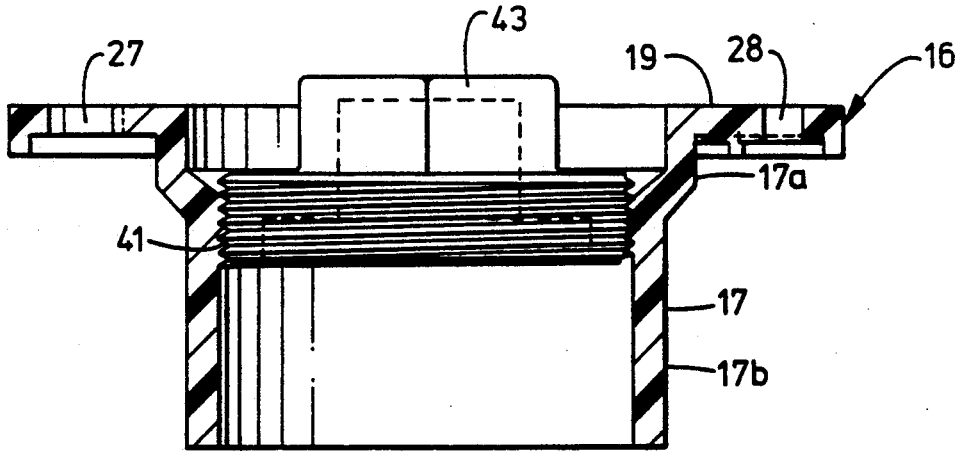
FIG. 5 is a cross-sectional view of the closet flange of FIG. 4, taken along section line 5—5 and illustrating the use of a conventional threaded plug therewith.

Reference is now made to FIGS. 4 and 5 wherein a closet flange according to the present invention is illustrated and generally indicated at 16. The closet flange 16 is molded of appropriate plastic material such as the aforementioned ABS or PVC. Closet flange 16 has a cylindrical body 17 comprising an upper portion 17*a* and a lower portion 17*b*. The upper portion 17*a* defines the entrance end of the closet flange. The lower body portion 17*b* is adapted to make a female connection with adjacent plumbing leading to the conventional soil pipe and vent assembly, as will be described with respect to FIG. 6.

The closet flange of the present invention also comes in a male version, as shown at 18 in FIG. 7, to be described hereinafter. The closet flange 16 of FIG. 5 and the closet flange 18 of FIG. 7 differ primarily in that they provide female and male connection, respectively, with the plumbing elements leading to the conventional soil pipe and vent assembly.

Both the female and male embodiments 16 and 18 are provided adjacent their entrance ends with outwardly extending annular attachment flanges 19 and 20. These attachment flanges enable their respective closet flange to be affixed to the floor or other appropriate supporting surface and enable a water closet to be affixed to the attachment flange, thereby essentially affixing the water closet to the floor. The flange 19 of the embodiment of FIG. 5 is most clearly shown in FIG. 4 The flange 19 is conventional and well-known. The flange 20 of the embodiment of FIG. 7 is, or can be, identical to the flange 19. Therefore, a brief description of the flange 19 can serve as a description of the flange 20, as well.

It is common practice to provide the flange 19 with at least one, and generally two pairs of diametrically opposed countersunk holes 21—21 and 22—22. At least one of the pairs 21—21 and 22—22 is used to accommodate screws 23 attaching the flange 19 or 20 to the adjacent floor 24. This is clearly shown in FIG. 7.

Returning to FIG. 4, the attachment flange 19 is provided with a pair of radially inwardly extending, diametrically opposed, undercut notches 25 and 26. The flange 19 is also provided with a pair of identical, arcuate, undercut slots 27 and 28, each having an enlarged entrance end 27*a* and 28*a* and a narrow engagement end 27*b* and 28*b*. The notches 25 and 26 and the notches 27 and 28 are intended for the same purpose, both types of notches are adapted to be engaged by the head of a bolt fastening the water closet to the flange 19. Normally, only one diametric pair is used for this purpose. Since the purpose of notches 25, 26, 27, and slots 28 is the same, it would be within the scope of the invention to replace notches 25 and 26 with a second pair of slots similar to slots 27 and 28. Similarly, slots 27 and 28 could be replaced by a pair of slots similar to notches 25 and 26.

Figure 6:
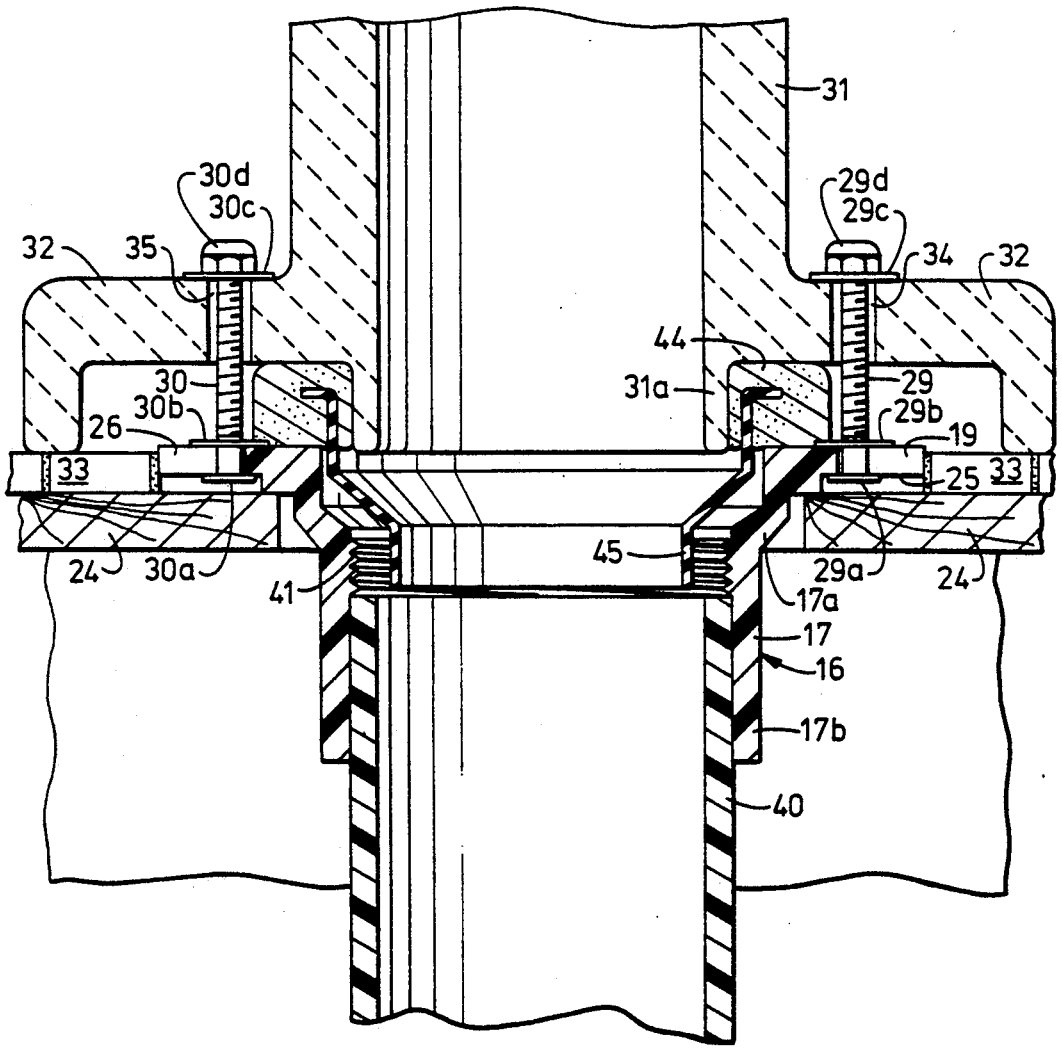
FIG. 6 is a fragmentary cross-sectional view taken along section line 6—6 of FIG. 4 and further illustrating the use of the closet flange to mount a water closet and to connected the water closet to plumbing elements leading to the soil pipe and vent assembly.

The use of notches 25 and 26, for example, is illustrated in FIG. 6. A pair of bolts 29 and 30 is provided. The bolt 29 has a head 29*a* and a captive washer 29*b*. The bolt head 29*a* is inserted in the undercut portion of notch 25 and the captive washer 29*b* maintains the bolt in an upright position. In similar fashion, the bolt 30 is provided with a head 30*a* and a captive washer 30*b* and is inserted in a similar fashion into undercut notch 26.

In FIG. 6, the lowermost outlet end of a water closet 31 is illustrated. The water closet 31 has a surrounding flange 32, the outermost peripheral edge of which contacts the tile 33 or other floor covering mounted on floor 24. The flange 32 is provided with diametrically opposed bores 34 and 35 adapted to accommodate bolts 29 and 30, respectively. The bolts 29 and 30 are thereafter provided with washers 29*c* and 30*c* and nuts 29*d* and 30*d* and in this fashion the water closet is solidly mounted to the attachment flange 19 or 20 of the closet flange 16 or 18. Frequently, the washers 29*c* and 30*c* and the nuts 29*d* and 30*d* are covered with decorative ceramic elements.

Figure 7:
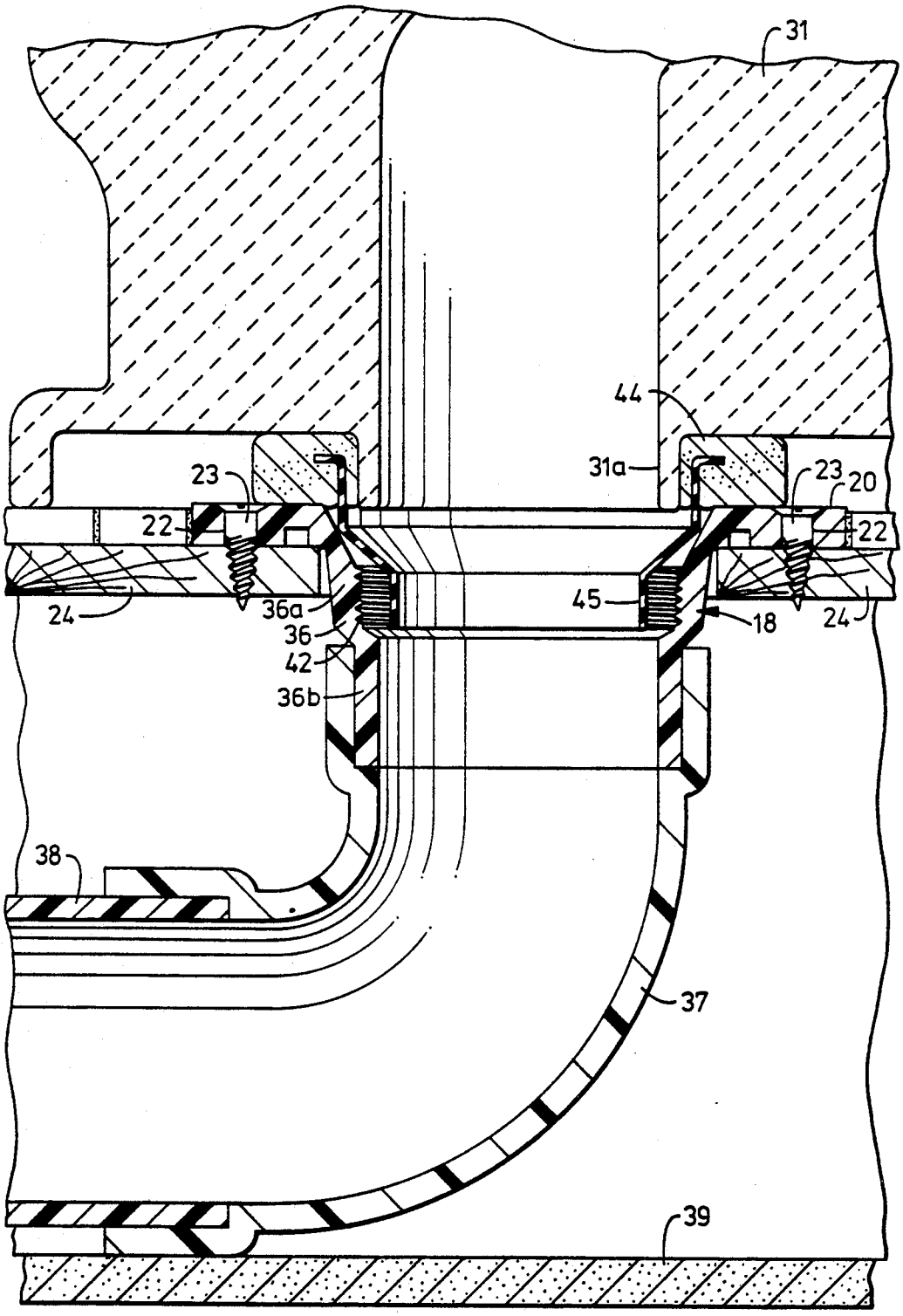
FIG. 7 is a fragmentary, cross-sectional view, similar to FIG. 6, and differing therefrom primarily in that the cross-section is taken transverse the water closet and along section line 7—7 of FIG. 4, and the lower body portion of the closet flange is configured to make a male connection with the adjacent plumbing element, rather than a female connection as in FIG. 6.

Referring to FIG. 7, the male embodiment 18 of the closet flange of the present invention has a cylindrical body 36 having an upper portion 36*a* and a lower portion 36*b*. The upper portion 36*a* defines the inlet end of the closet flange 18 and supports the annular exterior attachment flange 20 on the floor 24. The lower body portion 36*b* of the closet flange 18 has a smaller exterior diameter than the upper body portion 36*a*. As is shown in FIG. 7, the lower body portion 36*b* of the closet flange 18 extends through a perforation or opening in the floor and is adapted to be received in the upper end of a conventional elbow member 37. The lower body portion 36*b* of the closet flange is fixed within the upper end of elbow 37 by an appropriate adhesive means, as is well-known in the art. Similarly, a pipe element 38 is adhesively connected to the lower end of elbow 37. The pipe element 38 leads toward the conventional soil pipe and vent assembly. The male version 18 of the closet flange is used in the manner illustrated in FIG. 7 in instances wherein the plumbing leading to the conventional soil pipe and vent assembly is to be confined between the floor 24 and the ceiling 39 of the room therebelow.

The female version 16 of the closet flange of the present invention is normally used where the plumbing elements leading from the closet flange to the conventional soil pipe and vent assembly are not subject to such severe room constraints. For example, under some circumstances, the plumbing elements extending between the closet flange and the soil pipe and vent assembly can be run below the floor joists. In such an instance, a piece of ordinary plastic pipe 40 may be located between the closet flange 16 and an elbow, such as elbow 37 of FIG. 7. As a result, the uppermost end of pipe 40 will be received within the lowermost body portion 17*b* of closet flange 16, and adhered therein by appropriate adhesive means.

As thus far described, the female and male embodiments 16 and 18 of the closet flange of the present invention have substantially all of the features of their basic prior art counterparts. The improvement constituting the present invention resides in the axial bore of each embodiment of the present invention, the axial bore being so configured as to provide a series of standard pipe threads. Such standard pipe threads are shown at 41 in the female closet flange embodiment 16 and at 42 in the male closet flange embodiment 18.

Turning to FIG. 5, there is shown in this Figure a standard plumbing screw plug 43 threadedly engaged with the closet flange threads 41. It will be understood by one skilled in the art that the plug 43 could be similarly threadedly engaged with the threads 42 of closet flange embodiment 18. Thus, the closet flange embodiments of the present invention can have their axial bores closed and sealed, utilizing a standard plumbing screw plug, which is both easy to install and to remove.

It has been determined that the provision of a closet flange with standard pipe threads to accommodate a standard plumbing plug provides a number of advantages. For example, in many instances it is desirable to erect the plumbing in a house or building, with the installation of a water closet at some later date. The closet flange of the present invention enables the plumbing to be completed in the manner shown in FIG. 6 or FIG. 7, except for the mounting of a water closet. The axial bore of the closet flange can be easily closed off by a conventional screw plug to prevent dirt and foreign material from entering the plumbing. The engagement of the standard plug in the closet flange forms a seal adequate to permit the performance of air or water tests. The standard threaded plug precludes the possibility of "blow-off" during a water or air test.

In fact, during an air or water test, the plug 43 could be replaced by an air or water test gage having the same size base and threads.

When it is desired to install the water closet 31, in either of the arrangements illustrated in FIGS. 6 and 7, it is only necessary to remove the standard threaded plug 43 and bolt the water closet to the flange 19 or 20 in the manner described with respect to FIG. 6 or FIG. 7.

In either manner of installation, it is necessary to provide a seal between the water closet 31, its discharge rim 31*a* and the adjacent attachment flange 19 or 20. This is conventionally accomplished by the provision of a wax ring 44. In some installations, a horned wax ring could be used. In other words, the was ring 44 carries a metallic or plastic "horn" constituting a funnel-shaped device 45. The configuration of the entrance ends of the embodiments of the closet flange of the present invention are such that a horned wax ring can be employed with either embodiment.

From the above it will be apparent that the closet flange embodiments of the present invention are simpler and more convenient to use than prior art closet flanges, saving the plumber both time and money. Air or water testing can be practiced without fear of blow-out. Furthermore, the system can be opened for installation of a water closet by simple removal of a conventional threaded plumbing plug, rather than a knock-out plug, or having to remove a wafer cap previously glued in place.

Modifications may be made in the invention without departing from the spirit of it.

What is claimed is:

1. A closet flange for mounting a water closet to a supporting surface and for connecting said water closet to plumbing means leading to a soil pipe and vent assembly, said closet flange comprising a cylindrical body with an axial bore, said cylindrical body having upper and lower portions, said lower body portion being configured for connection to said plumbing means, said upper body portion defining the entrance end of said body, an exterior, annular attachment flange means located at said entrance end for attachment to said supporting surface with said body extending through a perforation in said supporting surface and for attachment of said water closet thereto, said axial bore being internally threaded with standard pipe threads at said upper body position for threaded engagement by a standard threaded screw plug whereby to selectively close said axial bore and to seal said axial bore for air or water testing prior to the mounting of said water closet.

2. The structure claimed in claim 1 wherein said closet flange comprises a unitary one-piece integral member molded of polyvinylchloride (PVC).

3. The structure claimed in claim 1 wherein said closet flange comprises a unitary one-piece integral member molded of acrylonitrile-butadiens-styrene (ABS).

* * * * *